US005493838A

United States Patent [19]

Ross

[11] Patent Number: 5,493,838

[45] Date of Patent: Feb. 27, 1996

[54] METHOD OF CONSTRUCTING A CONCRETE BASEMENT FROM PREFABRICATED CONCRETE PANELS

[76] Inventor: David Ross, Box 57, Worsley, Alberta, Canada, T0H 3W0

[21] Appl. No.: 239,112

[22] Filed: May 6, 1994

[51] Int. Cl.[6] ..... E04B 1/00

[52] U.S. Cl. ..... 52/745.1; 52/741.13; 52/250; 52/745.13; 405/229

[58] Field of Search ..... 52/741.11, 741.13, 52/741.14, 745.1, 745.13, 169.6, 169.7, 250, 251; 405/229

[56] References Cited

U.S. PATENT DOCUMENTS

| | | | |
|---|---|---|---|
| 790,514 | 5/1905 | Meara . | |
| 973,165 | 10/1910 | Cahill . | |
| 1,236,387 | 8/1917 | Moore . | |
| 1,445,713 | 2/1923 | Reilly . | |
| 1,462,622 | 11/1922 | Phelan . | |
| 1,484,206 | 2/1924 | Birkholz . | |
| 1,563,593 | 12/1925 | Schall . | |
| 1,606,882 | 11/1926 | Lichtenberg et al. | 52/250 |
| 1,634,283 | 7/1927 | Birkholz . | |
| 1,699,651 | 1/1929 | Bennett . | |
| 1,757,763 | 5/1930 | Betzler . | |
| 1,770,781 | 7/1930 | Jenkins . | |
| 1,819,405 | 8/1931 | Brooks . | |
| 1,834,892 | 12/1931 | Betzler . | |
| 2,184,464 | 12/1939 | Myers | 72/39 |
| 2,202,745 | 5/1940 | Muse | 72/1 |
| 3,662,506 | 5/1972 | Dillon | 52/251 X |
| 3,727,707 | 4/1973 | Machala | 52/169.6 X |
| 3,798,860 | 3/1974 | Mason | 52/285 |
| 3,874,139 | 4/1975 | Landwoski | 52/251 |
| 4,290,246 | 9/1981 | Hilsey | 52/741.13 X |
| 4,432,176 | 2/1984 | Balzer | 52/293 |
| 4,649,677 | 3/1987 | Oldham | 52/741.11 X |
| 4,658,551 | 4/1987 | Roux | 52/250 X |
| 4,901,491 | 2/1990 | Phillips | 52/250 X |
| 5,199,233 | 4/1993 | Fukutomi et al. | 52/169 |

FOREIGN PATENT DOCUMENTS

| | | | |
|---|---|---|---|
| 910590 | 6/1946 | France . | |
| 915004 | 10/1946 | France . | |
| 855906 | 11/1952 | Germany . | |
| 538053 | 7/1940 | United Kingdom | 52/251 |
| 2255127 | 10/1992 | United Kingdom | E04H 7/20 |

*Primary Examiner*—Carl D. Friedman
*Assistant Examiner*—Beth A. Aubrey
*Attorney, Agent, or Firm*—Anthony R. Lambert

[57] ABSTRACT

A method of constructing a concrete basement from prefabricated concrete wall panels is described. Firstly, excavate earth from an intended building site and position footings in the excavation to define an outline of a building with precast concrete floor panels positioned between the footings. Secondly, place prefabricated free standing concrete corner sections onto the footings at each point where it is intended that the building have a corner. Thirdly, secure a plurality of prefabricated concrete wall panels in end to end relation between the corner sections thereby completing a peripheral wall. Each of the concrete wall panels has an interior grid of reinforcing rod and a plurality of equally spaced substantially vertical ribs. Each of the ribs has an attachment member at the upper end which is secured to the reinforcing rod grid. Fourthly, construct a subfloor and secure each of the ribs of the concrete panels to the subfloor by means of the attachment member. The securely attached subfloor provides the top of the concrete wall panels and the interposed floor panels provide the bottom of the concrete wall panels with sufficient lateral stability to withstand backfilling.

6 Claims, 13 Drawing Sheets

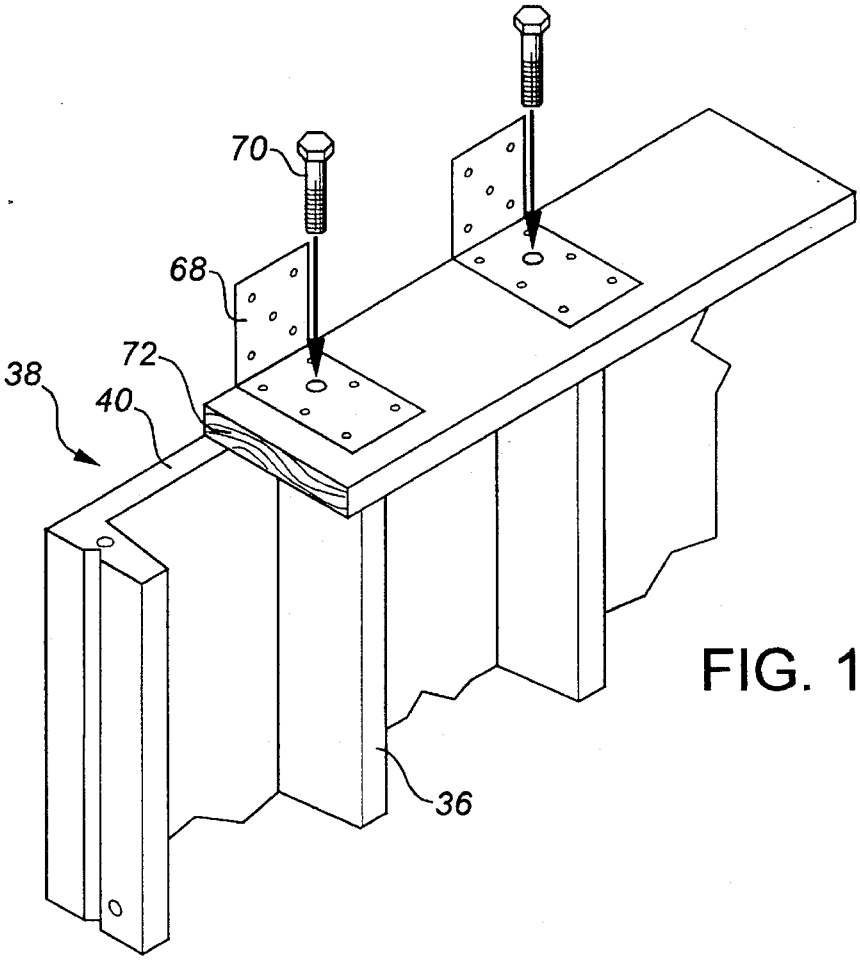
FIG. 18.
FIG. 19.
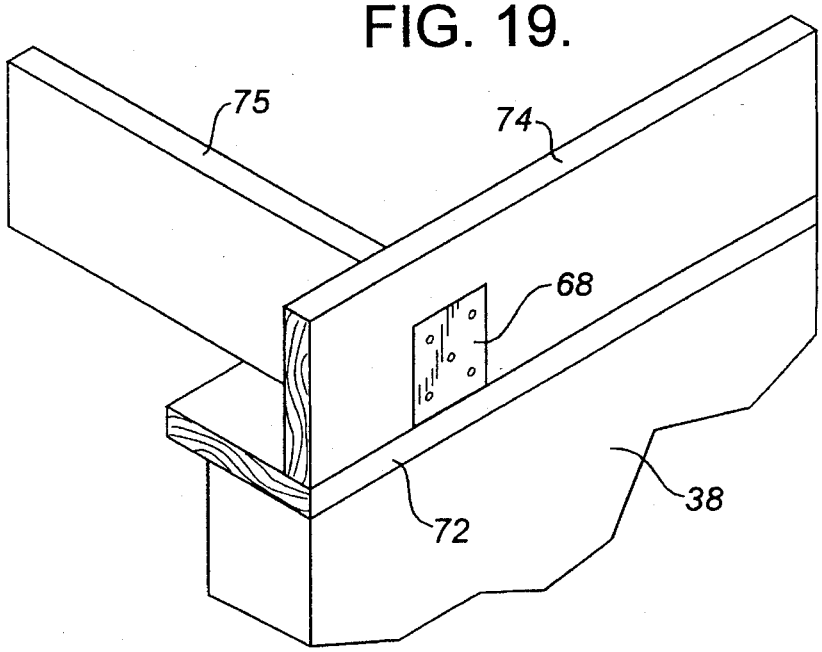

METHOD OF CONSTRUCTING A CONCRETE BASEMENT FROM PREFABRICATED CONCRETE PANELS

The present invention relates to a method of constructing a concrete basement from prefabricated concrete wall panels.

BACKGROUND OF THE INVENTION

Prefabricated concrete wall panels are used in a variety of building applications. They have not, however, proven suitable for use in constructing concrete basements. When concrete wall panels are used the basement wall tends to shift laterally where the panels join during backfilling. This is particularly a problem where the panels meet forming a corner. The result is that prefabricated concrete wall panels cannot be used in basement construction without securing the concrete wall panels to a poured in place concrete foundation. The need for poured in place concrete greatly reduces the advantages sought to be gained from using prefabricated concrete wall panels.

SUMMARY OF THE INVENTION

What is required is a method of constructing a concrete basement from prefabricated concrete wall panels without using poured in place concrete.

According to the present invention there is provided a method of constructing a concrete basement from prefabricated wall panels. This method involved the hereinafter described steps. Firstly, excavate earth from an intended building site and position footings in the excavation to define an outline of a building with concrete floor panels positioned between the footings. Secondly, place prefabricated free standing concrete corner sections onto the footings at each point where it is intended that the building have a corner. Thirdly, secure a plurality of prefabricated concrete wall panels in end to end relation between the corner sections thereby completing a peripheral wall. Each of the concrete sections has an interior grid of reinforcing rod and a plurality of equally spaced substantially vertical ribs. Each of the ribs has an upper end with an attachment member which is secured to the reinforcing rod grid. The bottom of each of the concrete wall panels rests against the floor panels. Fourthly, construct a subfloor and secure each of the ribs of the concrete wall panels to the subfloor by means of the attachment member. The securely attached subfloor provides the top of the concrete wall panels and the interposed floor panels provide the bottom of the concrete wall panels with sufficient lateral stability to withstand backfilling.

There are several features of the described method which cooperate to provide the strength necessary to withstand backfilling. The use of free standing corner sections provides stability to the peripheral walls and eliminates shifting at the corners which previously occurred due to the weight of the material used for backfill. Securing each of the ribs to the subfloor prevents shifting of the top of the concrete wall panels. The positioning of the precast concrete floor panels prevents shifting of the bottom of the concrete wall panels.

BRIEF DESCRIPTION OF THE DRAWINGS

These and other features of the invention will become more apparent from the following description in which reference is made to the appended drawings, wherein:

FIG. 18 is a first detailed perspective view of subfloor construction illustrated in FIG. 4.

FIG. 19 is a second detailed view of subfloor construction illustrated in FIG. 4.

DETAILED DESCRIPTION OF THE PREFERRED EMBODIMENT

The preferred embodiment, a method of constructing a concrete basement will now be described with reference to FIGS. 1 through 20.

Figure 1:
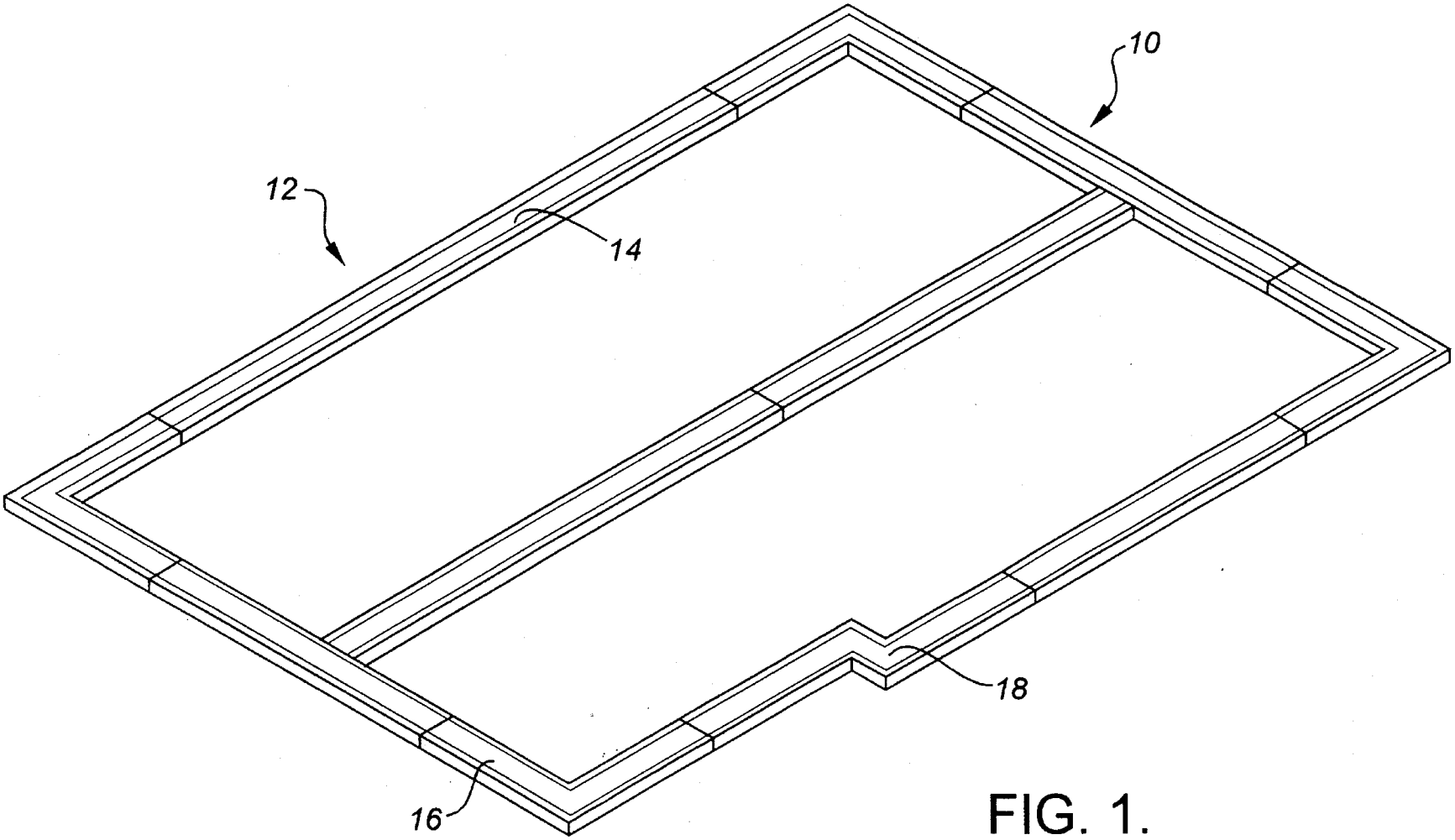
FIG. 1 is a perspective view of a first step in the described method.
Figure 5:
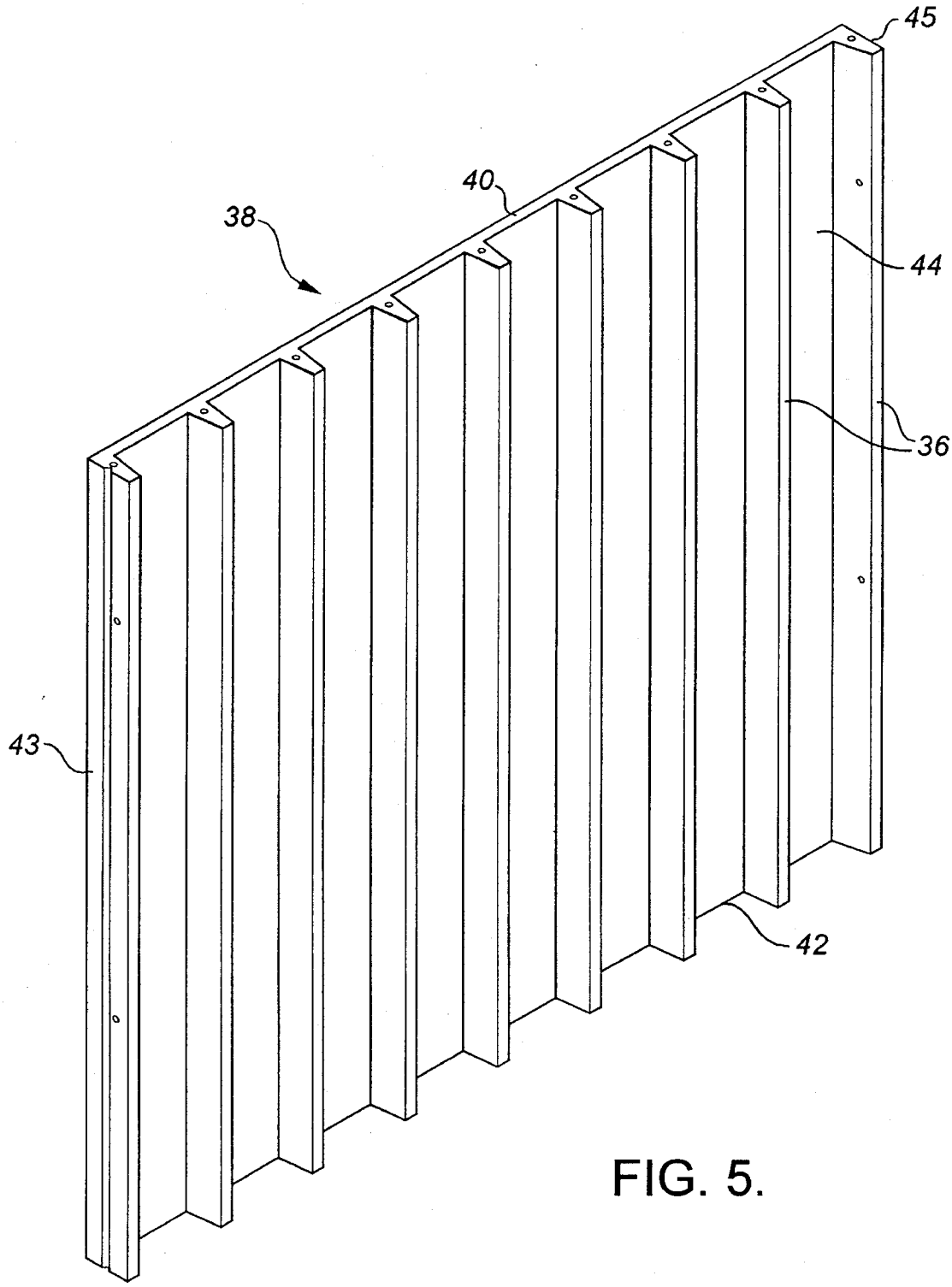
FIG. 5 is a perspective view of a precast wall panel.
Figure 6:
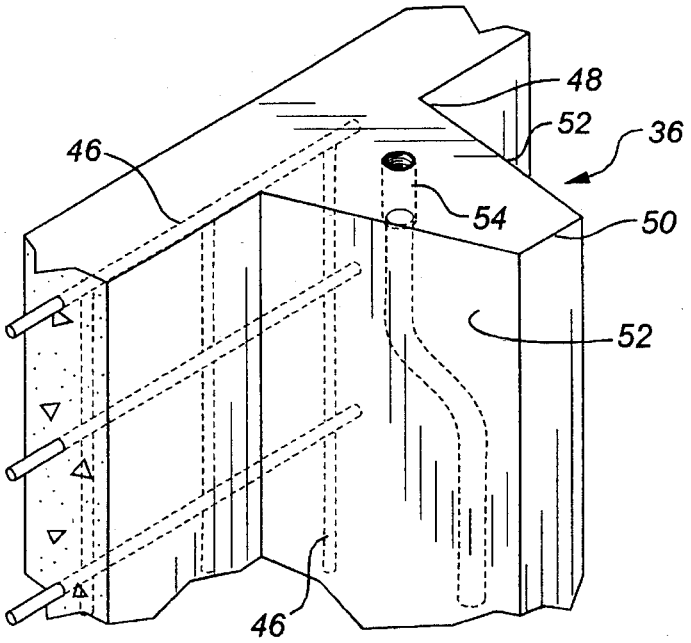
FIG. 6 is a detailed perspective view of an attachment member in the precast wall panel illustrated in FIG. 5.
Figure 7:
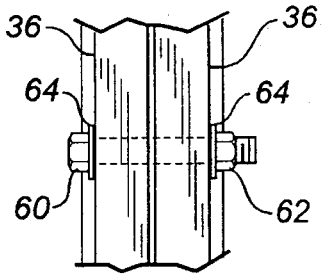
FIG. 7 is a detailed front elevation view of the manner of joining the all panels illustrated in FIG. 5.
Figure 8:
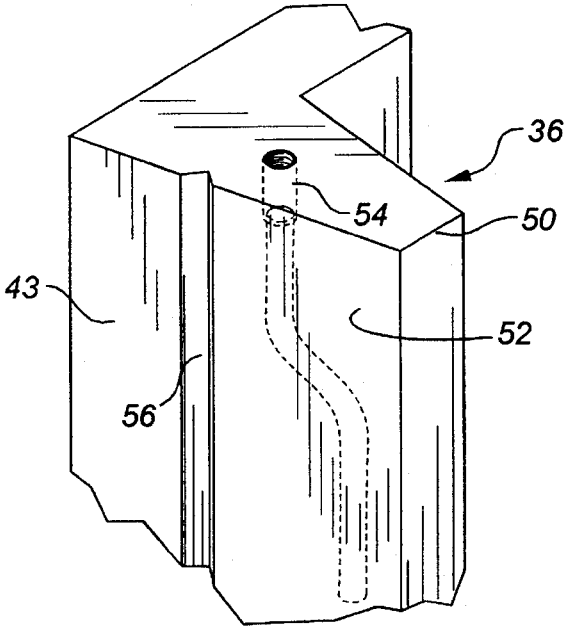
FIG. 8 is a detailed perspective view of an end of the precast wall panel illustrated in FIG. 5.
Figure 9:
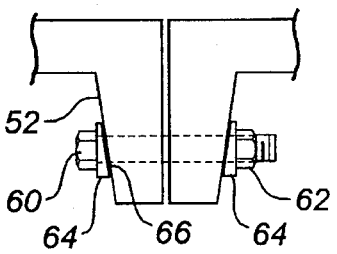
FIG. 9 is a detailed top plan view of washer detail of the manner of joining wall panels illustrated in FIG. 7.
Figure 10:
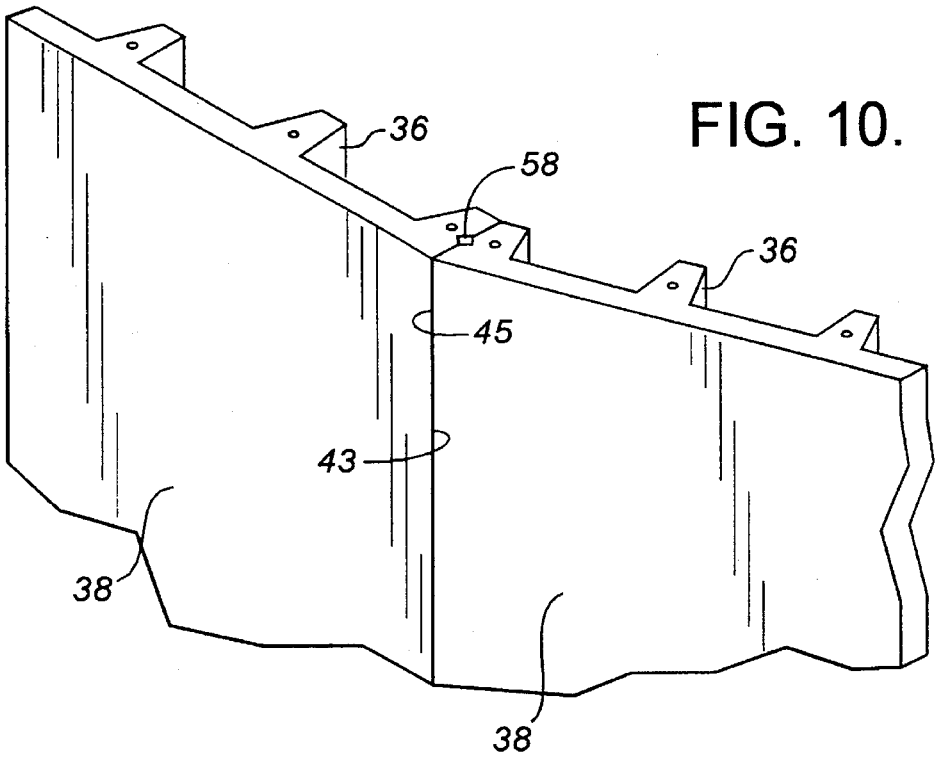
FIG. 10 is perspective view of two precast wall panels in end to end relation.
Figure 11:
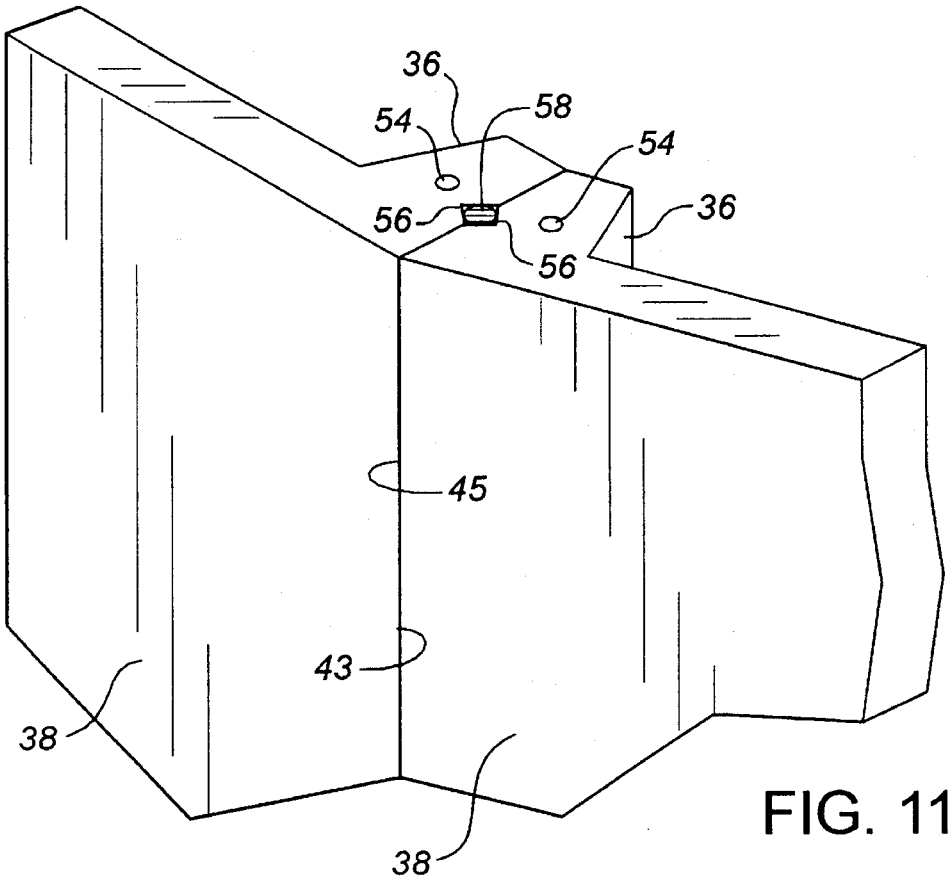
FIG. 11 is a detailed perspective view of a portion of the precast wall panels illustrated in FIG. 10.
Figure 13:
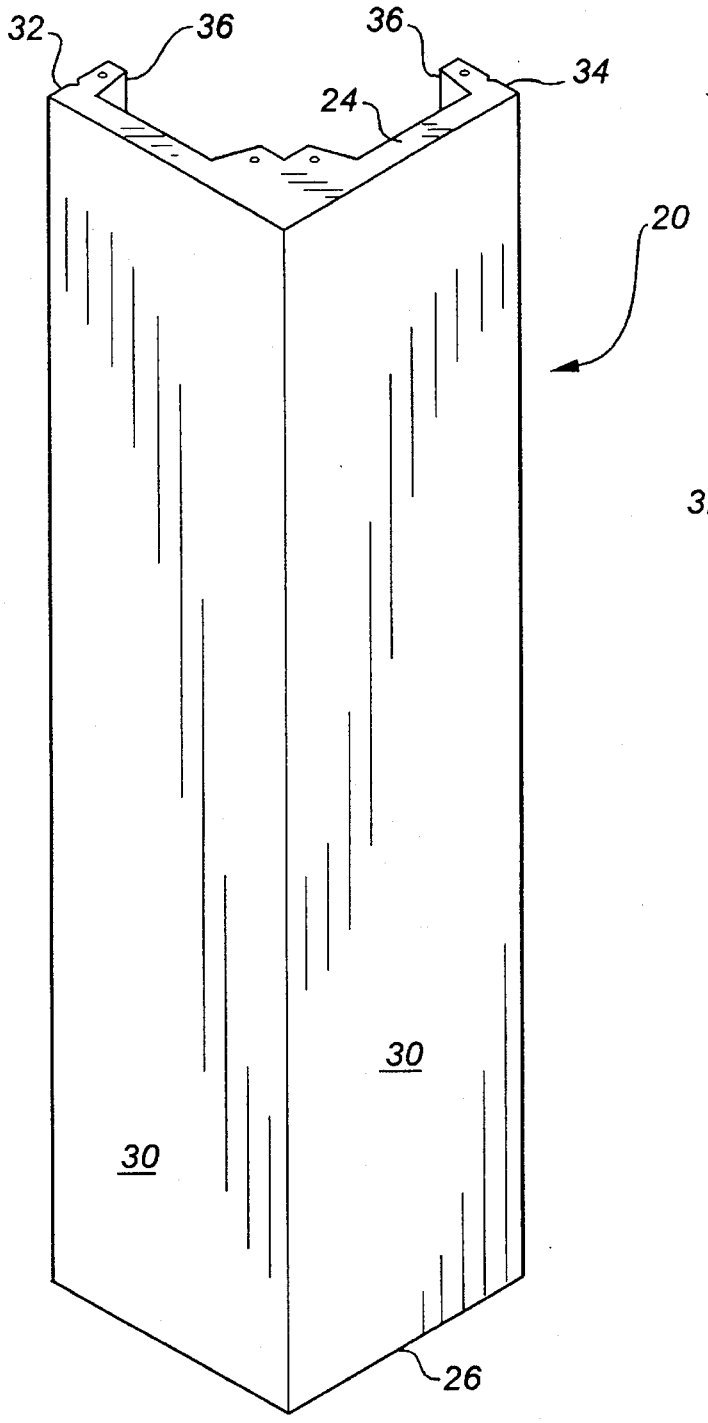
FIG. 13 is a perspective view of a self supporting outside corner.
Figure 14:
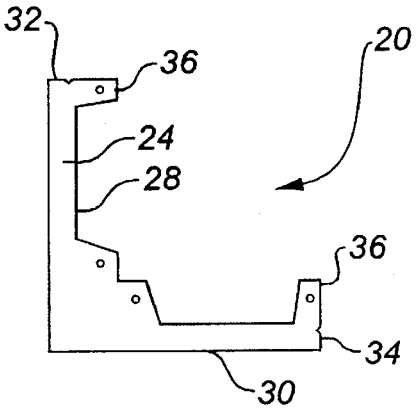
FIG. 14 is a section view taken along section lines A-A of the outside corner illustrated in FIG. 13.
Figure 15:
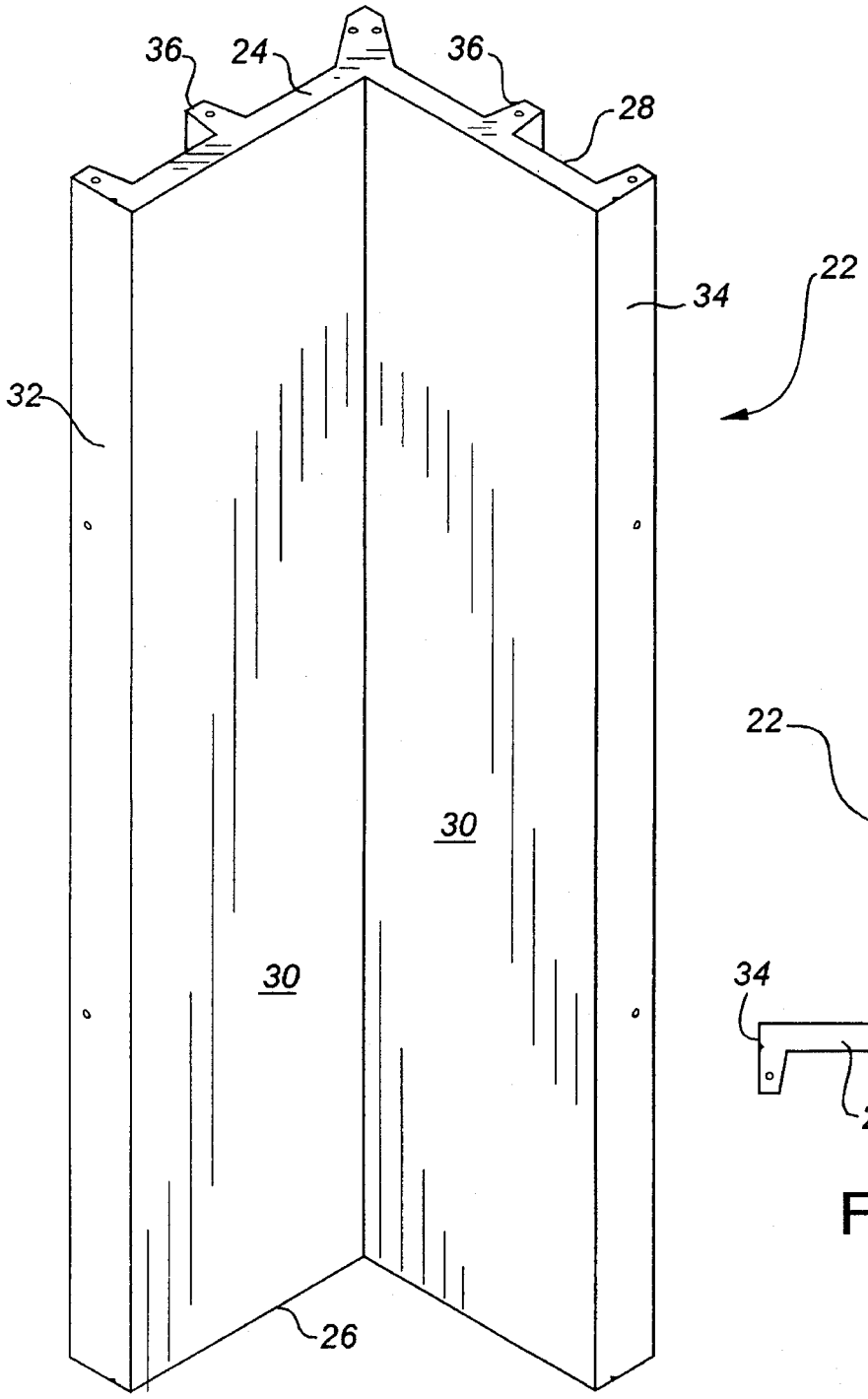
FIG. 15 is a perspective view of a self supporting inside corner.
Figure 16:
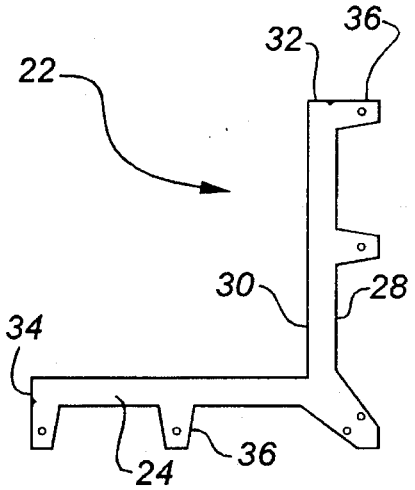
FIG. 16 is a section view taken along section lines B-B of FIG. 15.
Figure 17:
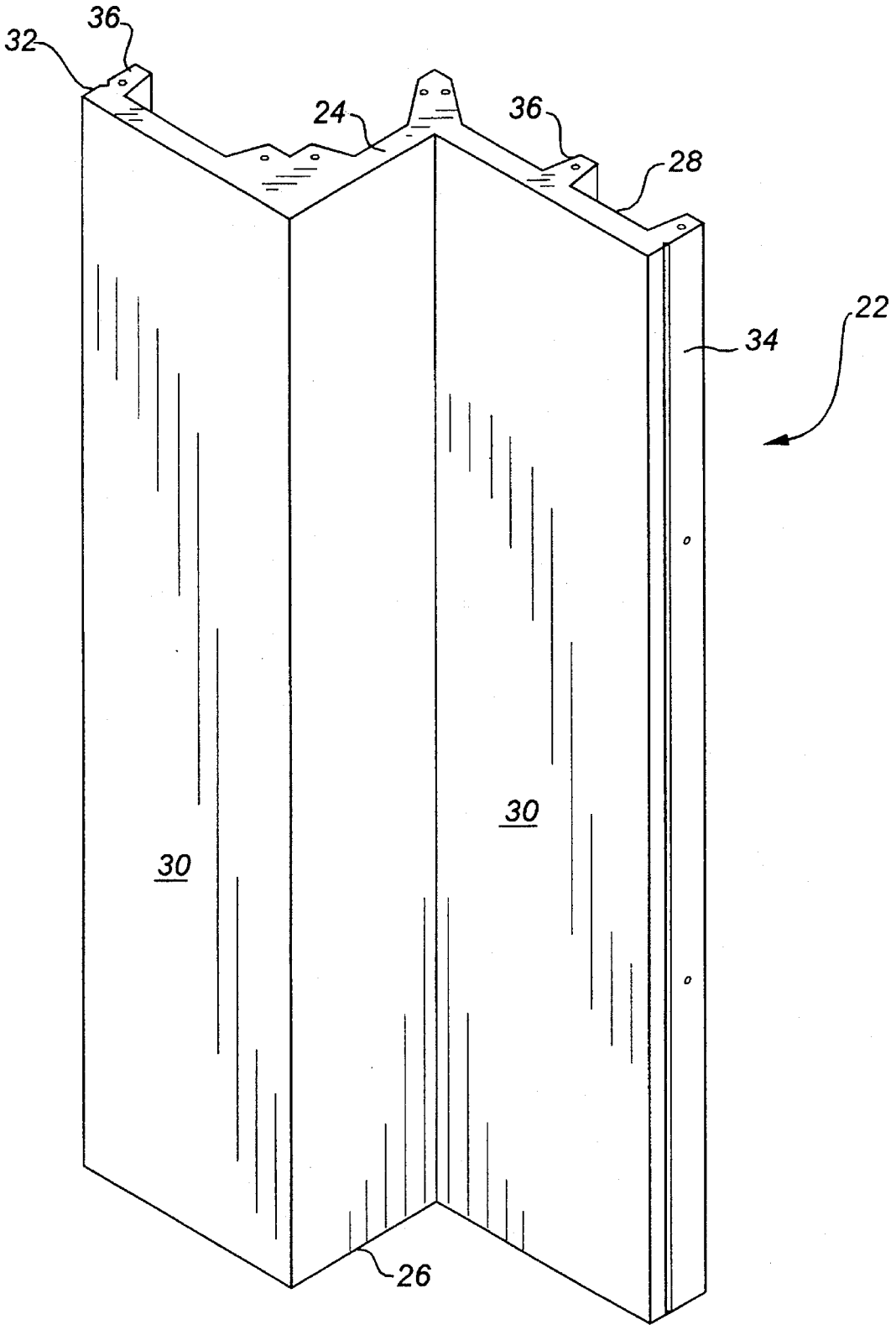
FIG. 17 is a perspective view of a precast offset section.

There will first be described the components which are used as part of the method. Referring to FIG. 1, precast concrete footings 12 are used. It should be noted that concrete footings 12 are precast in three shapes; a straight piece 14, a 90 degree corner piece 16 and a "Z" shaped piece 18. With these three precast shapes an outline of a house can be laid into a basement excavation. Referring to FIGS. 2, 3, 13, 14, 15, 16 prefabricated free standing corner sections 20 and 22 are used. The free standing aspect of corner sections 20 and 22 must be emphasized. Corner sections 20 and 22 "anchor" the system, as other components are tied to and rely for support upon corner sections 20. The construction of corner sections 20 and 22 varies depending upon whether they are intended for inside corners or outside corners. Corner sections 20, as illustrated in FIGS. 13 and 14 are intended for outside corners of a structure. Each of outside corner sections 20 has a top 24, a bottom 26, an inside face 28 that is intended to face an interior of a structure, an outside face 30 defining an outside of a structure and against which backfill is placed, and opposed ends 32 and 34. Ribs 36 project inwardly from inside face 28 at each of opposed ends 32 and 34. Corner sections 22, as illustrated in FIGS. 15, 16 and 17, are intended for inside corners that occur when a jog occurs in a wall. Like reference numerals will be used to identify like elements shared by outside corner sections 20 with inside corner sections 22. Each of inside corner sections 22 has a top 24, a bottom 26, an inside face 28 that is intended to face an interior of a structure, an outside face 30 defining an outside of a structure and against which backfill is placed, and opposed ends 32 and 34. Ribs 36 project inwardly from inside face 28, however, unlike with outside corner sections 20, ribs 36 of inside corner sections 22 are positioned at equally spaced intervals, preferably on 16 inch centers. Referring to FIG. 5, precast concrete panels 38 and 39 are used for walls and floors, respectively. Each precast concrete panel 38 and 39 has a top 40, a bottom 42, opposed ends 43 and 45, and an inside face 44 with a plurality of equally spaced inwardly directed substantially vertical ribs 6 that extend between top 40 and bottom 42. Referring to FIG. 6, both corner sections 20, 22 and concrete panels 38 and 39 have an interior grid of reinforcing rod 46. Ribs 36 on concrete corner sections 20 and 22 and concrete panels 38 and 39 are of a truncated wedge shape having a broad end 48, a narrow truncated end 50 and angular side faces 52. Each of ribs 36 has an attachment member in the form of a female threaded insert 54 positioned adjacent top 24 and 40 of corner sections 20, 22 and concrete panel 38, respectively. Threaded inserts 54 are secured to reinforcing rod grid 46. Referring to FIGS. 8, 10, and 11, ends 32 and 34 of corner sections 20, 22 and ends 43 and 45 of panels 38 and 39 have a longitudinally extending substantially vertical seal groove 56. When one of panels 38 or 39 is placed in end to end relation with another of panels 38 or 39, or one of corner sections 20 and 22 is placed in end to end relation with concrete wall panel 38, mating seal grooves 56 accommodate a sealing strip 58. Referring to FIG. 11, it should be noted that it is possible to custom design wall panels 38 with angular ends 43 and 45 where an angle between adjoining panels is desired. Referring to FIG. 7, wall panels 38 and corner sections 20, 22 are fastened together by means of bolts 60, nuts 62, and washers 64. Referring to FIG. 9, washers 64 have angular faces 66 that correspond to the angle of angular side faces 52. Referring to FIGS. 18 and 19, a generally "L" shaped anchor plate 68 and a plate bolt 70 are used to attach a wooden top plate 72 and tie into floor joists 74 and 75 that form a subfloor, as will hereinafter be further described.

Figure 2:
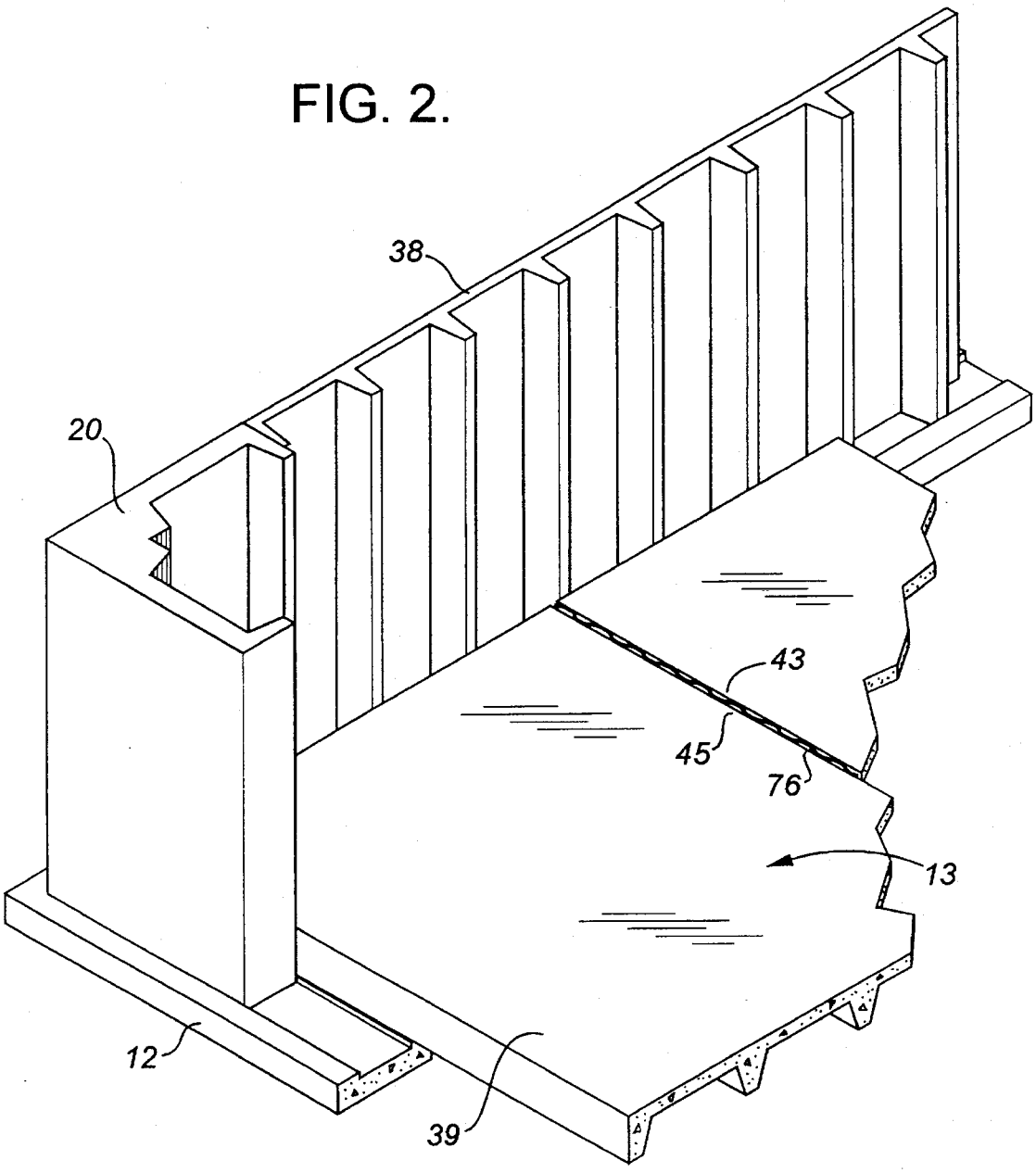
FIG. 2 is a perspective view of a second step in the described method.
Figure 3:
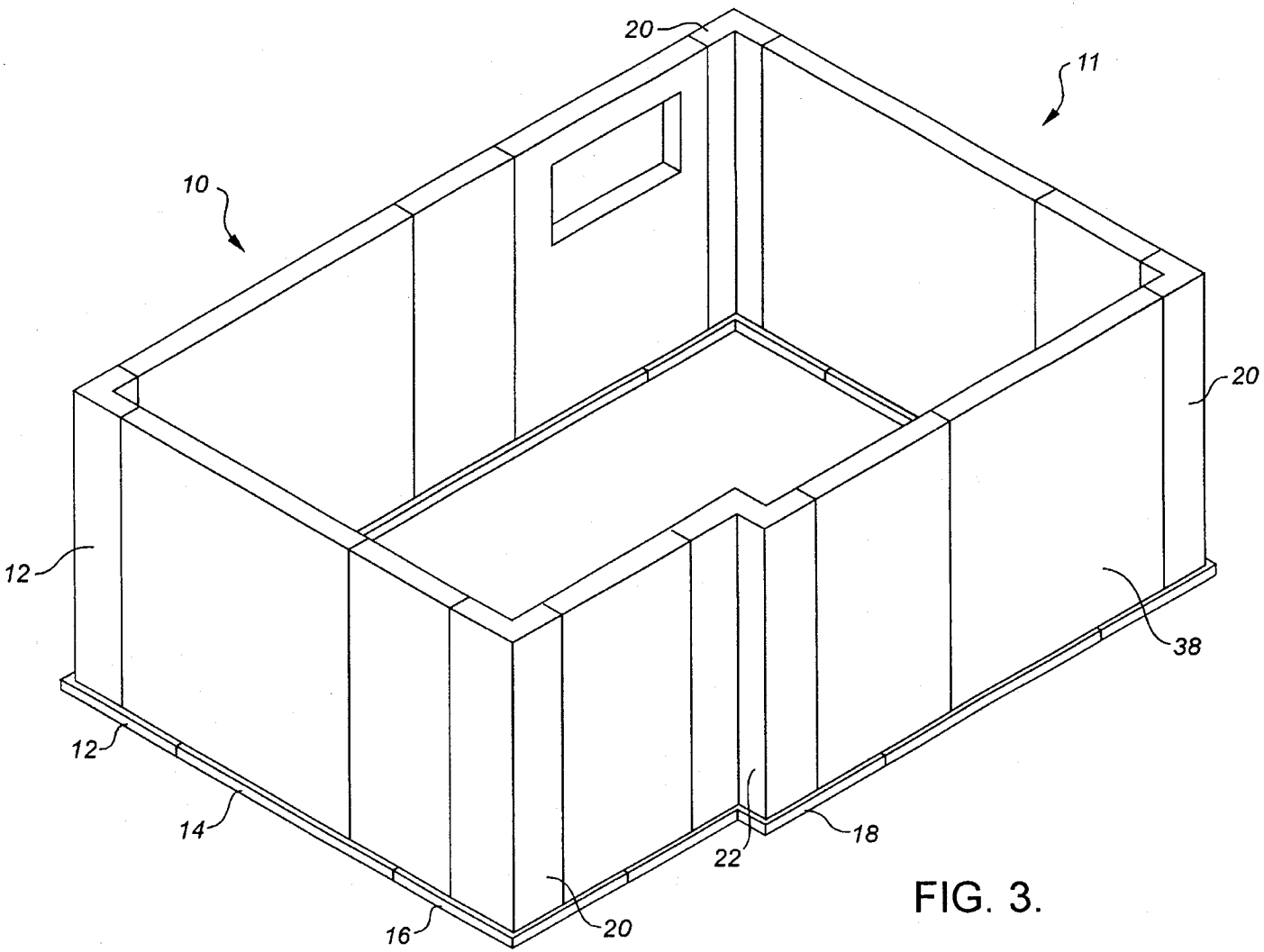
FIG. 3 is a perspective view of a third step in the described method.
Figure 4:
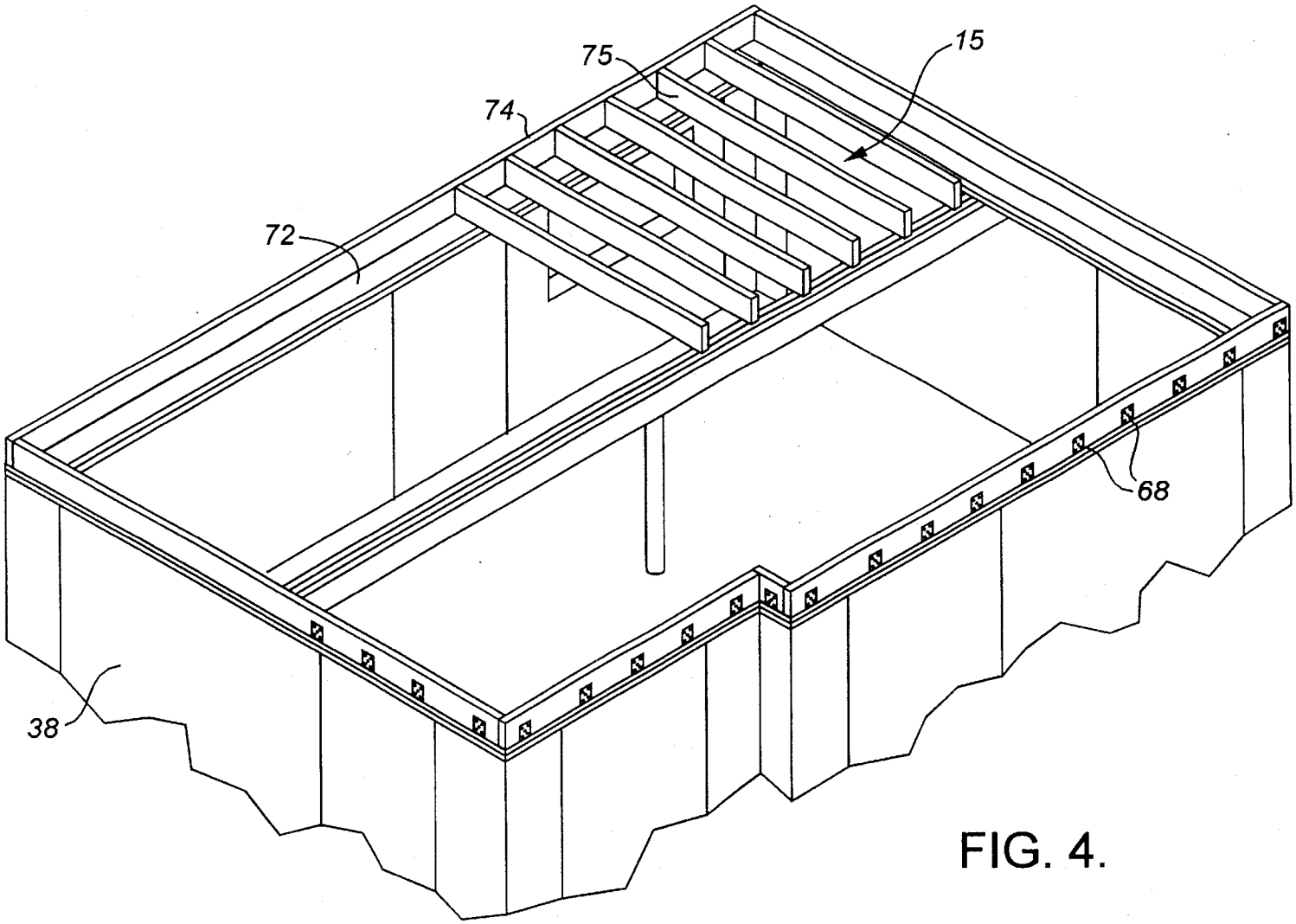
FIG. 4 is a perspective view of a fourth step in the described method.
Figure 12:
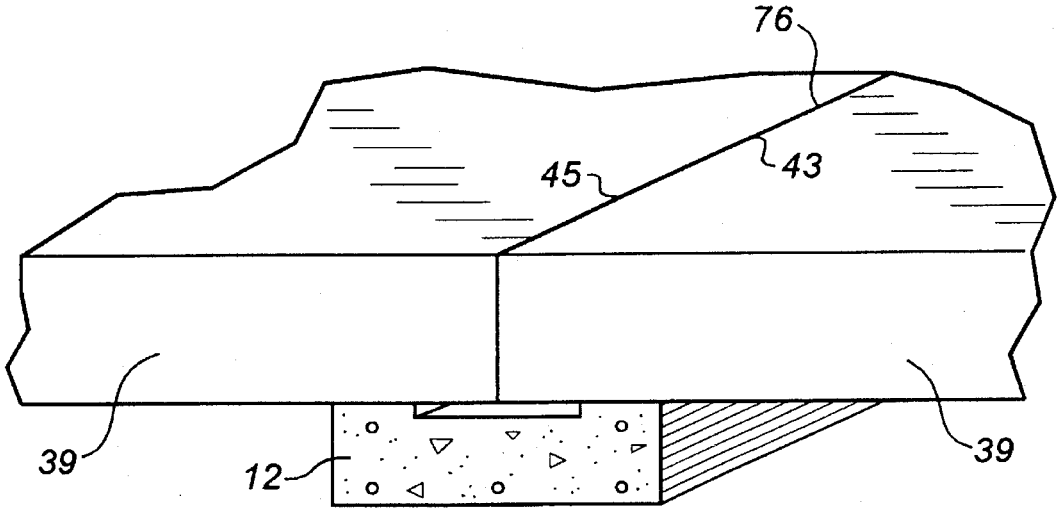
FIG. 12 is a detailed perspective view a portion of the precast floor panels illustrated in FIG. 2.
Figure 20:
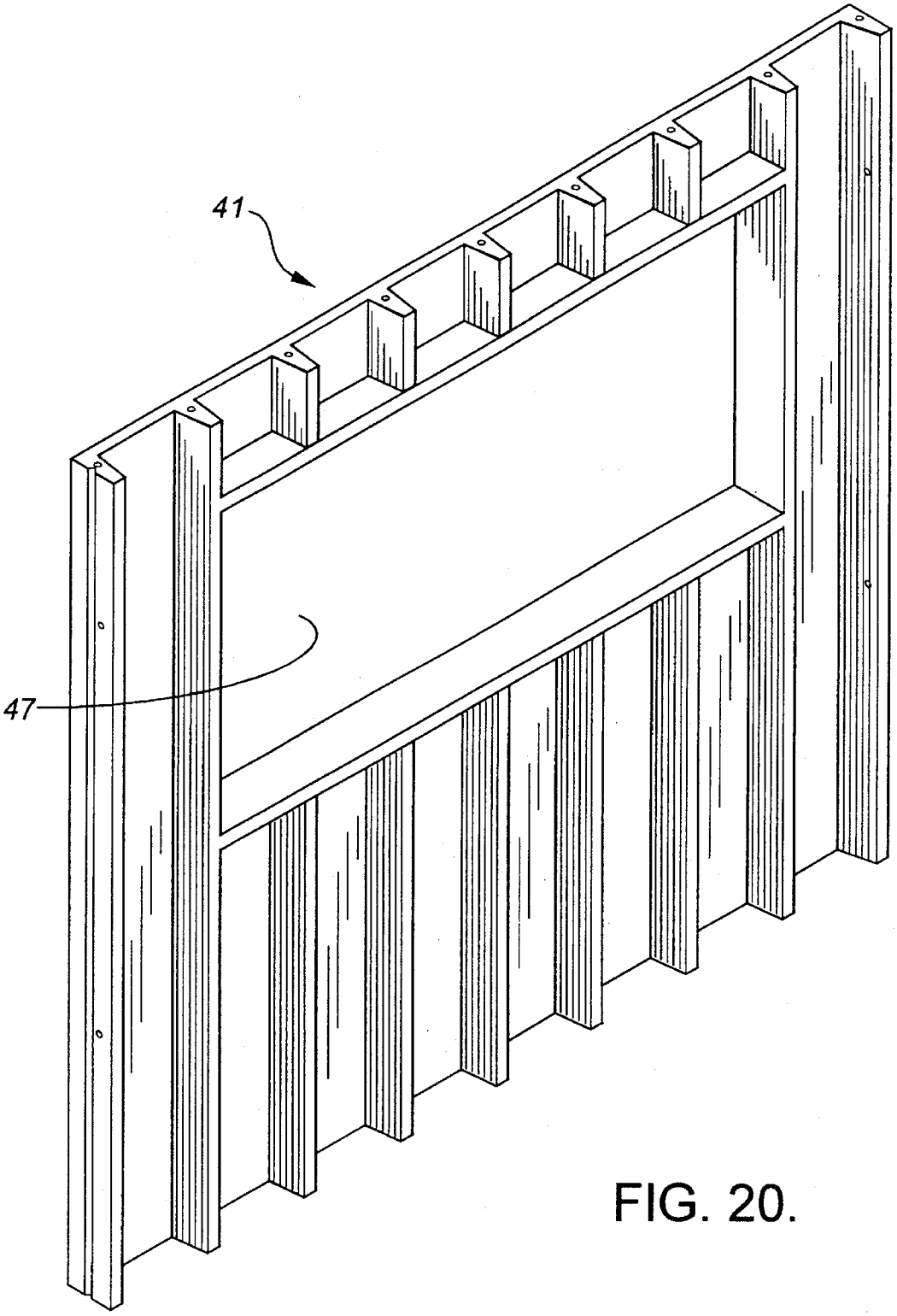
FIG. 20 is a perspective view of a precast wall panel having a precast window opening.

The method of constructing a concrete basement will now be described with reference to the above described components. Firstly, with reference to FIG. 1, excavate earth from an intended building site and position straight piece 14, corner piece 16 and "Z" shaped piece 18 of footings 12 in the excavation to define an outline of a building, which will hereinafter be identified by reference numeral 10. Referring to FIG. 2, prefabricated concrete floor panels 39 are placed on and span between footings 12. The floor panels form a floor, generally identified by reference numeral 13. Referring to FIG. 12, where ends 43 and 45 of floor panels 39 forming floor 13 meet, they are preferably sealed with grout 76. Secondly, with reference to FIG. 2, place prefabricated free standing concrete corner sections 20 and 22 onto footings 12 at each point where it is intended that building 10 have a corner. Thirdly, with reference to FIGS. 2 and 3, secure a plurality of prefabricated concrete wall panels 38 in end to end relation between corner sections 20 and 22 thereby completing a peripheral wall, generally identified by reference numeral 11. It should be noted that bottom 42 of wall panels 38 rest against floor panels 39. Referring to FIG. 20, where a window is desired a special concrete wall panels 41 is provided with a frangible concrete membrane 47 which defines an area to accommodate window openings. The window openings are completed to the correct size in situ by removing a portion of frangible membrane 47. The manner of securing together wall panels 38 is by means of bolts 60, nuts 62 and washers 64 as illustrated in FIGS. 7 and 9. Angular faces 66 on washers 64 enable a tight engagement with angular side faces 52 on ribs 36. Referring to FIGS. 10 and , the connection between ends 43 and 45 of each wall panel 38 with another wall panel 38 or with ends 32 and 34 of corner sections 20, 22 is sealed by sealing strip 58. Fourthly, with reference to FIG. 4, construct a subfloor, generally identified by reference numeral 15. Referring to FIGS. 8 and 9, subfloor is secured to each of ribs 36 of wall panels 38 and corner sections 20 and 22. This is achieved by placing wooden top plate 72 across top 24 of corner sections 20, 22 and across top 40 of panels 38. "L" shaped anchor plates 68 are placed on top of each female threaded insert 54 and plate bolts 70 are threaded into threaded insert 54 to securely fasten wooden top plates 72 and "L" shaped anchor plates 68 to peripheral walls 11. Subfloor 15 is then completed by securing a transverse floor joist 74 in an upright position transversely across a plurality of anchor plates 68 and then securing floor joists 75 perpendicularly to floor joist 74.

It will be apparent to one skilled in the art the advantages that the described method provide. The weakness in other modes of basement construction is that peripheral walls 11 could not withstand the pressure of backfilling. One of the areas where peripheral walls 11 were particularly vulnerable was the corners, as shifts would occur where peripheral walls 11 joined at the corners. The use of corner sections 20 and 22 strengthens that portion of peripheral walls 11. The other problem that occurred during backfilling was peripheral wall 11 being pressed inwardly at either the bottom or the top. In order to prevent this from occurring persons were previously force to cement into position any precast concrete sections so that movement would not occur. With the method, as described, the bottom is maintained in position by the positioning of floor 13. The top is maintained in position by attaching subfloor 15 in such a manner that it is directly attached to each of ribs 36. This is done through the use of an attachment member in the form of a female threaded insert 54, which is tied right into reinforcing rod grid 46 for added strength. Subfloor 15 provides top of peripheral wall 11 with sufficient lateral stability to withstand backfilling. It is the interrelationship of components that enables this system to utilize even precast footings 12. This enables the entire installation to be completed without any cement being hauled to the construction site. All work is performed with precast components. It will be apparent to one skilled in the art that modifications may be made to the illustrated embodiment without departing from the spirit and scope of the invention as defined by the claims.

The embodiments of the invention in which an exclusive property or privilege is claimed are as follows:

1. A method of constructing a concrete basement from prefabricated concrete wall panels, comprising the steps of:

a. firstly, excavating earth from an intended building site and positioning footings in the excavation to define an outline of a building with precast concrete floor panels positioned between the footings;

b. secondly, placing prefabricated free standing concrete corner sections onto the footings at each point where it is intended that the building have a corner;

c. thirdly, securing a plurality of prefabricated concrete wall panels in end to end relation between the corner sections thereby completing a peripheral wall, each of the concrete wall panels having a top, a bottom and an interior grid of reinforcing rod and a plurality of equally spaced substantially vertical ribs that extend between the top and the bottom, each of the ribs having an attachment member adjacent the top which is secured to the reinforcing rod grid, the bottom of each of the concrete wall panels rests against the floor panels; and d. fourthly constructing a subfloor and securing each of the ribs of the concrete wall panels to the subfloor by means of the attachment member, such that the securely attached subfloor provides the top of the concrete wall panels and the interposed floor panels provide the bottom of the concrete wall panels with sufficient lateral stability to withstand backfilling.

2. The method as defined in claim 1, wherein bolts are the means used to secure the concrete wall panels in end to end relation.

3. The method as defined in claim 2, wherein the cross-sectional shape of the ribs is that of a truncated wedge and washers are used having angular faces that correspond to the angle of the wedge.

4. The method as defined in claim 1, wherein the panels have opposed ends with longitudinal seal grooves adapted to receive a sealing strip.

5. The method as defined in claim 1, wherein the concrete wall panels have frangible concrete membranes over window openings, such that the window openings are completed to the correct size in situ by removing a portion of the frangible membrane.

6. A method of constructing a concrete basement, comprising the steps of:

a. firstly, excavating earth from an intended building site and positioning footings in the excavation to define an outline of a building with precast concrete floor panels positioned between the footings;

b. secondly, placing prefabricated free standing concrete corner sections onto the footings at each point where it is intended that the building have a corner;

c. thirdly, securing by means of bolts a plurality of prefabricated concrete wall panels in end to end relation between the corner sections thereby completing a peripheral wall, each of the concrete wall panels having a top, a bottom, opposed ends and an interior grid of reinforcing rod and a plurality of equally spaced substantially truncated wedge-shaped vertical ribs that extend between the top and the bottom, each of the ribs having an attachment member adjacent the top which is secured to the reinforcing rod grid, the bottom of each of the concrete wall panels resting against the floor panels, longitudinal seal grooves being positioned at the opposed ends of the panel, the seal grooves receiving a sealing strip, washers having angular faces that correspond to the angle of the wedge-shaped ribs being used to ensure tight engagement between the ribs and the bolts, the concrete wall panels having frangible concrete membranes over window openings, such that the window openings are completed to the correct size in situ by removing a portion of the frangible membrane; and d. fourthly constructing a subfloor and securing each of the ribs of the concrete wall panels to the subfloor by means of the attachment member, such that the securely attached subfloor provides the top of the concrete wall panels and the interposed floor panels provide the bottom of the concrete wall panels with sufficient lateral stability to withstand backfilling.

* * * * *